US008255231B2

(12) United States Patent
Villemoes et al.

(10) Patent No.: US 8,255,231 B2
(45) Date of Patent: Aug. 28, 2012

(54) ENCODING AND DECODING OF AUDIO SIGNALS USING COMPLEX-VALUED FILTER BANKS

(75) Inventors: Lars Falck Villemoes, Jarfalla (SE); Erik Gosuinus Petrus Schuijers, Eindhoven (NL)

(73) Assignees: Koninklijke Philips Electronics N.V., Eindhoven (NL); Dolby International AB, Amsterdam Zuid-Oost (NL)

( * ) Notice: Subject to any disclaimer, the term of this patent is extended or adjusted under 35 U.S.C. 154(b) by 1233 days.

(21) Appl. No.: 11/718,238

(22) PCT Filed: Oct. 31, 2005

(86) PCT No.: PCT/IB2005/053545

§ 371 (c)(1),
(2), (4) Date: Apr. 30, 2007

(87) PCT Pub. No.: WO2006/048814

PCT Pub. Date: May 11, 2006

(65) Prior Publication Data

US 2009/0063140 A1 Mar. 5, 2009

(30) Foreign Application Priority Data

Nov. 2, 2004 (EP) ..... 04105457
Sep. 9, 2005 (EP) ..... 05108293

(51) Int. Cl.
*G10L 19/00* (2006.01)
*G10L 19/14* (2006.01)

(52) U.S. Cl. ..... 704/501; 704/205

(58) Field of Classification Search ..... None
See application file for complete search history.

(56) References Cited

U.S. PATENT DOCUMENTS

| | | | | |
|---|---|---|---|---|
| 6,271,771 | B1 | 8/2001 | Seitzer et al. | |
| 6,349,284 | B1 | 2/2002 | Park et al. | |
| 6,996,198 | B2 * | 2/2006 | Cvetkovic | 375/350 |
| 7,333,034 | B2 * | 2/2008 | Matsumoto et al. | 341/61 |
| 7,555,434 | B2 * | 6/2009 | Nomura et al. | 704/500 |

(Continued)

FOREIGN PATENT DOCUMENTS

JP 2001-521648 11/2001

(Continued)

OTHER PUBLICATIONS

Schuijers, et al. "Low complexity parametric stereo coding", 116th AES Convention, Berlin, Germany, May 8-11, 2004.*

(Continued)

*Primary Examiner* — Brian Albertalli
(74) *Attorney, Agent, or Firm* — Michael A. Glenn; Glenn Patent Group

(57) ABSTRACT

An encoder (109) comprises a receiver (201) which receives a time domain audio signal. A filter bank (203) generates a first subband signal from the time domain audio signal where the first subband signal corresponds to a non-critically sampled complex subband domain representation of the time domain signal. A conversion processor (205) generates a second subband signal from the first subband signal by sub-band processing. The second subband signal corresponds to a critically sampled complex subband domain representation of the time domain audio signals. An encode processor (207) then generates a waveform encoded data stream by encoding data values of the second subband signal. The conversion processor (205) generates the second subband signal by direct subband conversion without converting back to the time domain. The invention allows an oversampled subband signal typically generated in parametric encoding to be waveform encoded with reduced complexity. A decoder performs the inverse operation.

33 Claims, 7 Drawing Sheets

U.S. PATENT DOCUMENTS

| | | | | |
|---|---|---|---|---|
| 2004/0071284 | A1 * | 4/2004 | Abutalebi et al. | 379/406.08 |
| 2009/0259478 | A1 | 10/2009 | Nomura et al. | |

FOREIGN PATENT DOCUMENTS

| | | | |
|---|---|---|---|
| WO | WO 98/57436 | | 12/1998 |
| WO | WO 03/046891 | * | 6/2003 |
| WO | WO 2004/010415 | | 1/2004 |
| WO | WO-2004027368 | A1 | 4/2004 |
| WO | WO 2005043511 | A1 * | 5/2005 |

OTHER PUBLICATIONS

Hermann et al., "Low-Power Implementation of the Bluetooth Subband Audio Codec", in Proceedings of the IEEE International Conference on Acoustics, Speech and Signal Processing (ICASSP 2004), Montreal, Canada, May 2004.*

Kleiwer et al., "Oversampled Cosine-Modulated Filter Banks with Arbitrary System Delay", IEEE Transactions on Signal Processing, vol. 46, No. 4, pp. 941-955, 1998.*

Decision to Grant, dated Jun. 2010, in parallel Russian patent application No. 2007120591, 10 pages.

Heiko Purnhagen; Low Complexity Parametric Stereo Coding in MPEG-4; Proc. Of the 7th Int. Conference on Digital Audio Effects (DAFx'04), Naples, Italy, Oct. 5-8, 2004; 6 pages.

* cited by examiner

ENCODING AND DECODING OF AUDIO SIGNALS USING COMPLEX-VALUED FILTER BANKS

The invention relates to encoding and/or decoding of audio signals and in particular to waveform encoding/decoding of an audio signal.

Digital encoding of various source signals has become increasingly important over the last decades as digital signal representation and communication increasingly has replaced analogue representation and communication. For example, mobile telephone systems, such as the Global System for Mobile communication, are based on digital speech encoding. Also distribution of media content, such as video and music, is increasingly based on digital content encoding.

Traditionally, audio encoding has predominantly used waveform encoding wherein the underlying waveform has been digitized and efficiently encoded. For example, a typical waveform encoder comprises a filter bank converting the signal to a frequency subband domain. Based on a psychoacoustical model, a masking threshold is applied and the resulting subband values are efficiently quantized and encoded, for example using a Huffman code.

Examples of waveform encoders include the well known MPEG-1 Layer 3 (often referred to as MP3) or AAC (Advanced Audio Coding) encoding schemes.

In recent years, a number of encoding techniques have been proposed which do not directly encode the underlying waveform but rather characterizes the encoded signals by a number of parameters. For example, for voice encoding, the encoder and decoder may be based on a model of the human voice tract and instead of encoding the waveform, various parameters and excitation signals for the model may be encoded. Such techniques are generally referred to as parametric encoding techniques.

Furthermore, waveform encoding and parametric encoding may be combined to provide a particularly efficient and high quality encoding. In such systems, the parameters may describe part of the signal with reference to another part of the signal which has been waveform encoded. For example, coding techniques have been proposed wherein the lower frequencies are waveform encoded and the higher frequencies are encoded by a parametric extension that describes properties of the higher frequencies relative to the lower frequencies. As another example, multi-channel signal encoding has been proposed wherein e.g. a mono signal is waveform encoded and a parametric extension includes parameter data indicating how the individual channels vary from the common signal.

Examples of parametric extension encoding techniques include Spectral Band Replication (SBR), Parametric Stereo (PS) and Spatial Audio Coding (SAC) techniques.

Currently the SAC technique is being developed to efficiently code multi-channel audio signals. This technology is partly based on the PS coding technique. Similarly to the PS paradigm, SAC is based on the notion that a multi-channel signal, consisting of M channels, can be efficiently represented by a signal consisting of N channels, with N<M, and a small amount of parameters representing the spatial cues. A typical application consists of coding a conventional 5.1 signal representation as a waveform encoded mono or stereo signal plus the spatial parameters. The spatial parameters can be embedded in the ancillary data portion of the core mono or stereo bit stream to form a backward compatible extension.

Like the SBR and PS techniques, SAC uses complex (pseudo) Quadrature Mirror Filter (QMF) banks in order to transform time domain representations to frequency domain representations (and vice versa). A characteristic of these filter banks is that the complex-valued sub-band domain signals are effectively oversampled by a factor of two. This enables post-processing operations of the sub-band domain signals without introducing aliasing distortion.

Another common characteristic for parametric extensions is that under typical conditions, these techniques do not achieve a transparent audio quality level, i.e. that some quality degradation is introduced.

In order to extend the parametric extensions like SBR, PS and SAC towards transparent audio quality it would be desirable to code certain parts, e.g. a certain number of bands, of the complex sub-band domain signals using a waveform coder.

A straightforward approach consists of first transforming these parts of the complex sub-band domain back to the time domain. An existing waveform coder (e.g. AAC) can then be applied to the resulting time domain signals. However, such an approach is associated with a number of disadvantages.

Specifically, the resulting encoder and decoder complexity is high and has a high computational burden because of the repeated conversions between the frequency and time domain using different transforms. For example, if the parametric extension would make use of coding the time domain signal obtained after QMF synthesis, the corresponding decoder would consist of a complete waveform decoder (e.g. an AAC derivative decoder) and additionally an analysis QMF bank. This is expensive in terms of computational complexity.

Furthermore, it would be beneficial to have a correlation between the parametric extension used and the waveform encoding of signal elements encoded by the parametric extension.

For example, a system may consist of e.g. AAC and SBR (HE-AAC) or AAC and SAC coding. If the system allows the SBR or SAC extension to be enhanced by means of waveform coding, it would be logical to also use AAC in order to encode the time domain signal obtained after QMF synthesis. However, another system, using the same extensions, e.g. the combination of MPEG-1 Layer II and SBR would preferably use another wave form coding system: MPEG-1 Layer II. Accordingly, it would be advantageous to couple the waveform coding enhancement to the parametric extension tool rather than to the core coder Hence, an improved system would be advantageous and in particular an encoding and/or decoding system allowing increased flexibility, reduced complexity, reduced computational burden, facilitated interoperation between different elements of the applied coding, improved (e.g. scalable) audio quality and/or improved performance would be advantageous.

Accordingly, the Invention seeks to preferably mitigate, alleviate or eliminate one or more of the above mentioned disadvantages singly or in any combination.

According to an aspect of the invention there is provided a decoder for generating a time domain audio signal by waveform decoding, the decoder comprising: means for receiving an encoded data stream; means for generating a first subband signal by decoding data values of the encoded data stream, the first subband signal corresponding to a critically sampled complex subband domain signal representation of the time domain audio signal; conversion means for generating a second subband signal from the first subband signal by subband processing, the second subband signal corresponding to a non-critically sampled complex subband domain representation of the time domain audio signal; and a synthesis filter bank for generating the time domain audio signal from the second subband signal.

The invention may allow an improved decoder. A reduced complexity decoder may be achieved and/or the computational resource requirement may be reduced. In particular, a synthesis filter bank may be used both for decoding a parametric, extension for the time domain audio signal and for waveform decoding. A commonality between waveform decoding and parametric decoding can be achieved. In particular, the synthesis filter bank can be a QMF filter bank as typically used for parametric decoding in parametric extension coding techniques such as SBR, PS and SAC.

The conversion processor is arranged to generate the second subband signal by subband processing without requiring any conversion of e.g. the first subband signal back to the time domain.

The decoder may further comprise means for performing non-alias signal processing on the second subband signal prior to the synthesis operation of the synthesis filter bank.

According to an optional feature of the invention, each subband of the first subband signal comprises a plurality of sub-subbands and the conversion means comprises a second synthesis filter bank for generating the subbands of the second subband signals from sub-subbands of the first subband signal.

This may provide an efficient means of converting the first subband signal. The feature may provide for an efficient and/or low complexity means of compensating for a frequency response of the subband filters of the synthesis filter bank.

According to an optional feature of the invention, each subband of the second subband signal comprises an alias band and a non-alias band and wherein the conversion means comprises splitting means for splitting a sub-subband of the first subband signal into an alias sub-subband of a first subband band of the second subband signal and a non-alias subband of a second subband of the second subband signal, the alias subband and the non-alias subband having corresponding frequency intervals in the time domain signal.

This may provide an efficient means of converting the first subband signal. In particular, it may allow signal components in different subbands originating from the same frequency in the time domain audio signal to be generated from a single signal component.

According to an optional feature of the invention, the splitting means comprises a Butterfly structure.

This may allow a particularly efficient implementation and/or high performance. The Butterfly structure may use one zero value input and one sub-subband data value input to generate two output values corresponding to different subbands of the second subband.

According to another aspect of the invention, there is provided an encoder for encoding a time domain audio signal, the encoder comprising: means for receiving the time domain audio signal; a first filter bank for generating a first subband signal from the time domain audio signal, the first subband signal corresponding to a non-critically sampled complex subband domain representation of the time domain signal; conversion means for generating a second subband signal from the first subband signal by subband processing, the second subband signal corresponding to a critically sampled complex subband domain representation of the time domain audio signals; and means for generating a waveform encoded data stream by encoding data values of the second subband signal.

The invention may allow an improved encoder. A reduced complexity encoder may be achieved and/or the computational resource requirement may be reduced. A commonality between waveform encoding and parametric encoding can be achieved. In particular, the first filter bank can be a QMF filter bank as typically used for parametric encoding in parametric extension coding techniques such as SBR, PS and SAC.

An improved decoded audio quality may be achieved. For example, the time domain audio signal may be a residual signal from a parametric encoding. The waveform encoded signal can provide information resulting in an increased transparency.

The conversion processor is arranged to generate the second subband signal by subband processing without requiring any conversion of e.g. the first subband signal back to the time domain.

According to an optional feature of the invention, the encoder further comprises means for parametrically encoding the time domain audio signal using the first subband signal.

The invention may allow an efficient and/or high-quality encoding of an underlying signal using both parametric and waveform encoding. Functionality may be shared between parametric and waveform coding. The parametric encoding may be a parametric extension coding such as a SBR, PS or SAC coding. The encoder may in particular provide for waveform encoding of some or all subbands of a parametric extension encoding.

According to an optional feature of the invention, the conversion means comprises a second filter bank for generating a plurality of sub-subbands for each subband of the first subband signal.

This may provide an efficient means of converting the first subband signal. The feature may provide for an efficient and/or low complexity means of compensating for a frequency response of the subband filters of the first subband.

According to an optional feature of the invention, the second filter bank is oddly stacked.

This may improve performance and allow improved separation between positive and negative frequencies in the complex subband domain.

According to an optional feature of the invention, each subband comprises some alias sub-subbands corresponding to an alias band of the subband and some non-alias sub-subbands corresponding to a non-alias band of the subband; and wherein the conversion means comprises combining means for combining alias sub-subbands of a first subband band with non-alias sub-subbands of a second subband, the alias sub-subbands and the non-alias sub-subbands having corresponding frequency intervals in the time domain signal.

This may provide an efficient means of converting the first subband signal. In particular, it may allow signal components in different subbands originating from the same frequency in the time domain audio signal to be combined into a single signal component. This may allow a reduction in the data rate.

According to an optional feature of the invention, the combining means are arranged to reduce an energy in the alias band.

This may improve performance and/or may allow a data rate reduction. In particular, the energy in the alias band may be minimized and the alias bands may be ignored.

In particular, the combining means may further comprise means for compensating non-alias sub-subbands of a first subband band by alias subbands of a second subband. In particular, the combining means may comprise means for subtracting the coefficients of the alias subbands of a second subband from the non-alias sub-subbands of a first subband.

According to an optional feature of the invention, the combining means comprises means for generating a non-alias sum signal for a first alias sub-subband in the first subband and a first non-alias sub-subband in the second subband.

This may allow a particularly efficient implementation and/or high performance.

According to an optional feature of the invention, the combining means comprises a Butterfly structure for generating the non-alias sum signal.

This may allow a particularly efficient implementation and/or high performance. The Butterfly structure may in particular be a half Butterfly structure wherein only one output value is generated.

According to an optional feature of the invention, at least one coefficient of the butterfly structure is dependent on a frequency response of a filter of the first filter bank.

This may allow efficient implementation and/or high-performance.

According to an optional feature of the invention, the conversion means is arranged to not include data values for the alias band in the encoded data stream.

This may allow a high encoded audio quality for a given data rate.

According to an optional feature of the invention, the encoder further comprises means for performing non-alias signal processing on the first subband signal prior to the conversion to the second signal.

This may improve performance. The invention may allow an efficient implementation of a waveform encoder having a critically sampled output signal while permitting signal processing of the individual subbands to be performed without introducing aliasing errors.

According to an optional feature of the invention, the encoder further comprises means for phase compensating the first subband signal prior to the conversion to the second signal.

This may improve performance and/or provide for an efficient implementation.

According to an optional feature of the invention, the first filter bank is a QMF filter bank.

The invention may allow an efficient waveform encoding using a QMF filter which is used in many parametric encoding techniques, such as SBR, PS, SAC. Thus, an improved compatibility and/or improved functionality sharing and/or improved interoperability of waveform and parametric encoding techniques can be achieved.

According to another aspect of the invention, there is provided a method of generating a time domain audio signal by waveform decoding, the method comprising: receiving an encoded data stream; generating a first subband signal by decoding data values of the encoded data stream, the first subband signal corresponding to a critically sampled complex subband domain signal representation of the time domain audio signal; generating a second subband signal from the first subband signal by subband processing, the second subband signal corresponding to a non-critically sampled complex subband domain representation of the time domain audio signal; and a synthesis filter bank generating the time domain audio signal from the second subband signal.

According to another aspect of the invention, there is provided a method of encoding a time domain audio signal, the method comprising: receiving the time domain audio signal; a first filter bank generating a first subband signal from the time domain audio signal the first subband signal corresponding to a non-critically sampled complex subband domain representation of the time domain signal; generating a second subband signal from the first subband signal by subband processing, the second subband signal corresponding to a critically sampled complex subband domain representation of the time domain audio signals; and generating a waveform encoded data stream by encoding data values of the second subband signal.

According to another aspect of the invention, there is provided a receiver for receiving an audio signal, the receiver comprising: means for receiving an encoded data stream; means for generating a first subband signal by decoding data values of the encoded data stream, the first subband signal corresponding to a critically sampled complex subband domain signal representation of the time domain audio signal; conversion means for generating a second subband signal from the first subband signal by subband processing, the second subband signal corresponding to a non-critically sampled complex subband domain representation of the time domain audio signal; and a synthesis filter bank for generating a time domain audio signal from the second subband signal.

According to another aspect of the invention, there is provided a transmitter for transmitting an encoded audio signal, the transmitter comprising: means for receiving a time domain audio signal; a first filter bank for generating a first subband signal from the time domain audio signal, the first subband signal corresponding to a non-critically sampled complex subband domain representation of the time domain signal; conversion means for generating a second subband signal from the first subband signal by subband processing, the second subband signal corresponding to a critically sampled complex subband domain representation of the time domain audio signals; and means for generating a waveform encoded data stream by encoding data values of the second subband signal; and means for transmitting the waveform encoded data stream.

According to another aspect of the invention, there is provided a transmission system for transmitting a time domain audio signal, the transmission system comprising: a transmitter comprising: means for receiving the time domain audio signal, a first filter bank for generating a first subband signal from the time domain audio signal, the first subband signal corresponding to a non-critically sampled complex subband domain representation of the time domain signal, conversion means for generating a second subband signal from the first subband signal by subband processing, the second subband signal corresponding to a critically sampled complex subband domain representation of the time domain audio signals, means for generating a waveform encoded data stream by encoding data values of the second subband signal, and means for transmitting the waveform encoded data stream; and a receiver comprising: means for receiving the waveform encoded data stream, means for generating a third subband signal by decoding data values of the encoded data stream, the third subband signal corresponding to a critically sampled complex subband domain signal representation of the time domain audio signal, conversion means for generating a fourth subband signal from the third subband signal by subband processing, the fourth subband signal corresponding to a non-critically sampled complex subband domain representation of the time domain audio signal; and a synthesis filter bank for generating a time domain audio signal from the fourth subband signal.

According to another aspect of the invention, there is provided a method of receiving an audio signal, the method comprising: receiving an encoded data stream; generating a first subband signal by decoding data values of the encoded data stream, the first subband signal corresponding to a critically sampled complex subband domain signal representation of the time domain audio signal; generating a second subband signal from the first subband signal by subband processing, the second subband signal corresponding to a non-critically sampled complex subband domain representation of the time domain audio signal; and a synthesis filter bank generating a time domain audio signal from the second subband signal.

According to another aspect of the invention, there is provided a method of transmitting an encoded audio signal, the method comprising: receiving a time domain audio signal; a first filter bank generating a first subband signal from the time domain audio signal, the first subband signal corresponding to a non-critically sampled complex subband domain representation of the time domain signal; generating a second subband signal from the first subband signal by subband processing, the second subband signal corresponding to a critically sampled complex subband domain representation of the time domain audio signals; and generating a waveform encoded data stream by encoding data values of the second subband signal; and transmitting the waveform encoded data stream.

According to another aspect of the invention, there is provided a method of transmitting and receiving a time domain audio signal, the method comprising: a transmitter: receiving the time domain audio signal, a first filter bank generating a first subband signal from the time domain audio signal, the first subband signal corresponding to a non-critically sampled complex subband domain representation of the time domain signal, generating a second subband signal from the first subband signal by subband processing, the second subband signal corresponding to a critically sampled complex subband domain representation of the time domain audio signals, generating a waveform encoded data stream by encoding data values of the second subband signal, and transmitting the waveform encoded data stream; and a receiver: receiving the waveform encoded data stream, generating a third subband signal by decoding data values of the encoded data stream, the third subband signal corresponding to a critically sampled complex subband domain signal representation of the time domain audio signal, generating a fourth subband signal from the third subband signal by subband processing, the fourth subband signal corresponding to a non-critically sampled complex subband domain representation of the time domain audio signal; and a synthesis filter bank generating a time domain audio signal from the fourth subband signal.

According to another aspect of the invention, there is provided a computer program product for executing any of the above described methods.

These and other aspects, features and advantages of the invention will be apparent from and elucidated with reference to the embodiment(s) described hereinafter.

Embodiments of the invention will be described, by way of example only, with reference to the drawings, in which FIG. 1 illustrates a transmission system 100 for communication of an audio signal in accordance with some embodiments of the invention;

Figure 1:
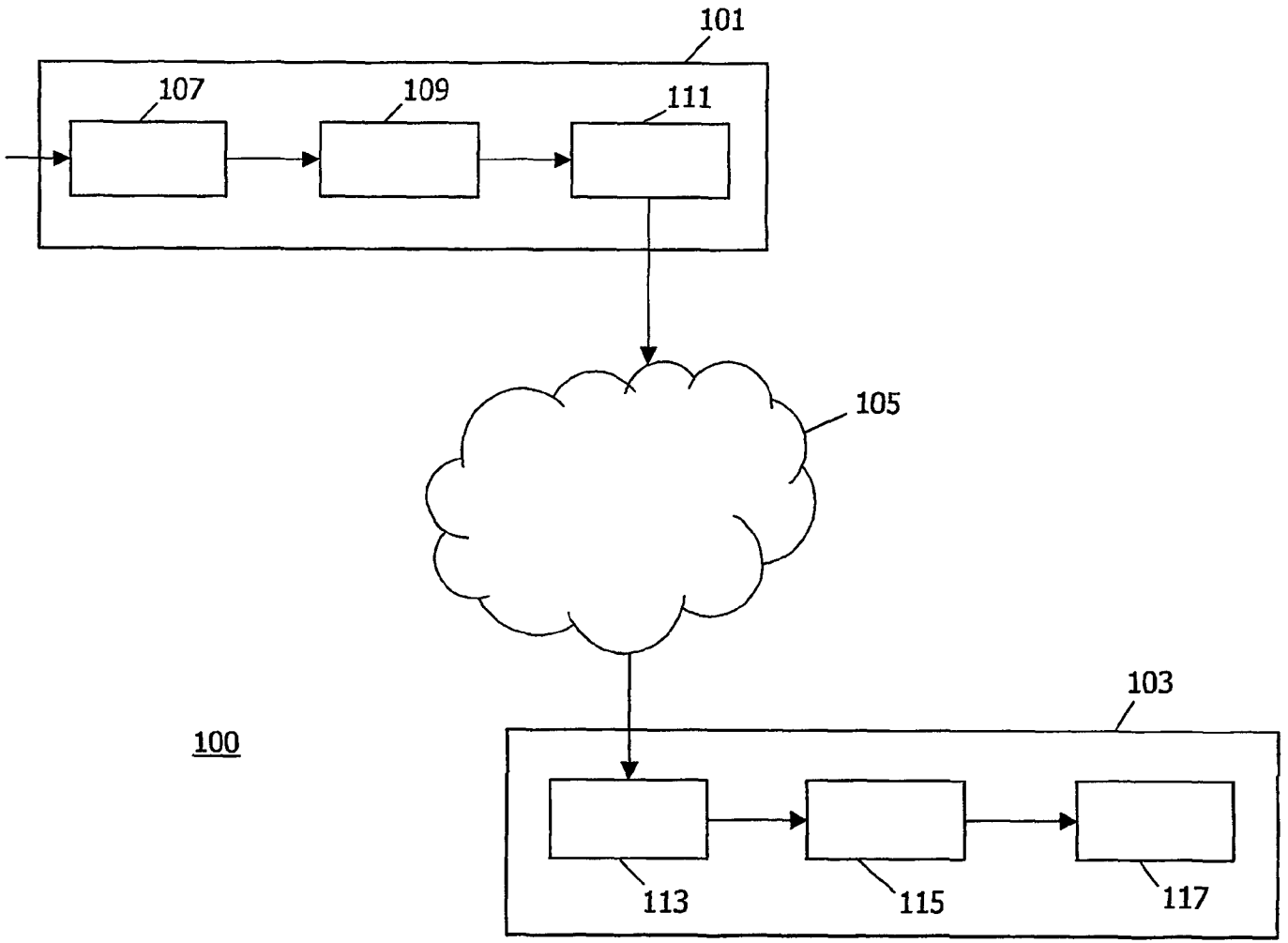

FIG. 1 illustrates a transmission system 100 for communication of an audio signal in accordance with some embodiments of the invention. The transmission system 100 comprises a transmitter 101 which is coupled to a receiver 103 through a network 105 which specifically may be the Internet.

In the specific example, the transmitter 101 is a signal recording device and the receiver is a signal player device 103 but it will be appreciated that in other embodiments a transmitter and receiver may used in other applications and for other purposes. For example, the transmitter 101 and/or the receiver 103 may be part of a transcoding functionality and may e.g. provide interfacing to other signal sources or destinations.

In the specific example where a signal recording function is supported, the transmitter 101 comprises a digitizer 107 which receives an analog signal that is converted to a digital PCM signal by sampling and analog-to-digital conversion.

The transmitter 101 is coupled to the encoder 109 of FIG. 1 which encodes the PCM signal in accordance with an encoding algorithm. The encoder 100 is coupled to a network transmitter 111 which receives the encoded signal and interfaces to the Internet 105.

The network transmitter may transmit the encoded signal to the receiver 103 through the Internet 105.

The receiver 103 comprises a network receiver 113 which interfaces to the Internet 105 and which is arranged to receive the encoded signal from the transmitter 101.

The network receiver 111 is coupled to a decoder 115. The decoder 115 receives the encoded signal and decodes it in accordance with a decoding algorithm.

In the specific example where a signal playing function is supported, the receiver 103 further comprises a signal player 117 which receives the decoded audio signal from the decoder 115 and presents this to the user. Specifically, the signal player 113 may comprise a digital-to-analog converter, amplifiers and speakers as required for outputting the decoded audio signal.

Figure 2:
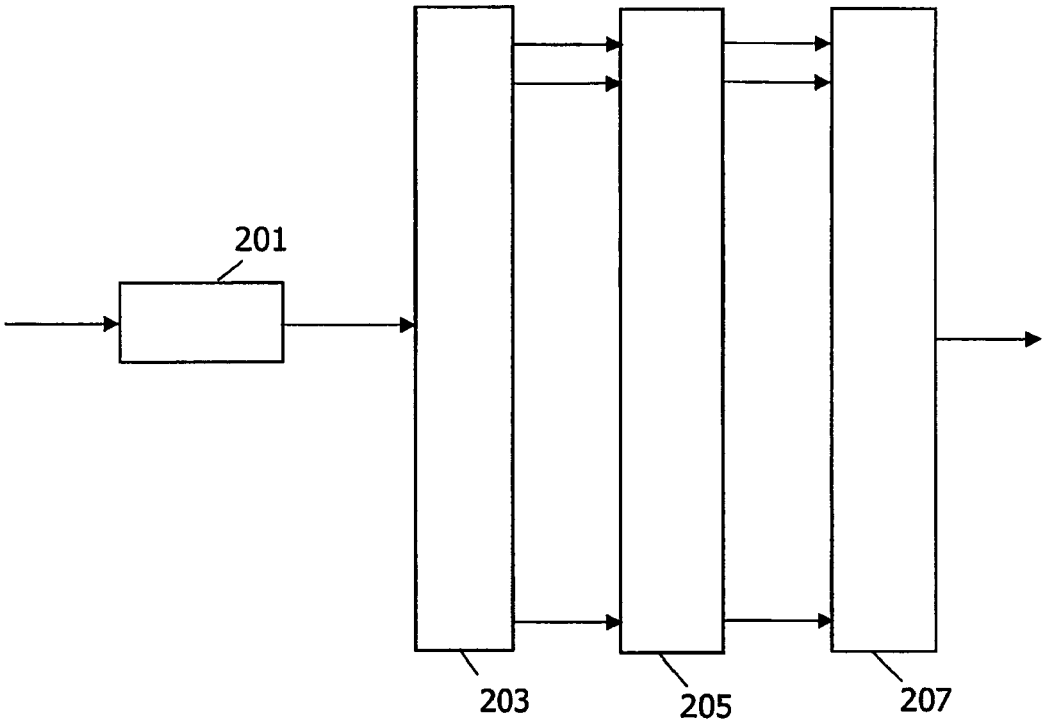
FIG. 2 illustrates an encoder in accordance with some embodiments of the invention.

FIG. 2 illustrates the encoder 109 of FIG. 1 in more detail. The encoder 109 comprises a receiver 201 which receives a time domain audio signal to be encoded. The audio signal may be received from any external or internal source, such as from a local signal storage.

The receiver is coupled to a first filter bank 203 which generates a subband signal comprising a plurality of different subbands. Specifically, the first filter bank 203 can be a QMF filter bank as known from parametric encoding techniques such as SBR, PS and SAC. Thus, the first filter bank 203 generates a first subband signal which corresponds to a non-critically sampled complex subband domain representation of the time domain signal. In the specific example, the first subband signal has an oversampling factor of two as is well-known for complex-modulated QMF filters.

Since each QMF band is oversampled by a factor of two, it is possible to perform many signal processing operations on the individual subbands without introducing any aliasing distortion. For example, each individual subband may e.g. be scaled and/or other subbands can be added or subtracted etc. Thus, in some embodiments, the encoder 109 further comprises means for performing non-alias signal processing operations on the QMF subbands.

The first subband signal corresponds to subband signals conventionally generated by parametric extension encoders such as SBR, PS and SAC. Thus, the first subband signal may be used to generate a parametric extension encoding for the time domain signal. In addition, the same subband signal is in the encoder 109 of FIG. 2 also used for a waveform encoding of the time domain signal. Thus, the encoder 109 can use the same filter bank 203 for parametric and waveform encoding of a signal.

The main difficulty in waveform coding the complex valued sub-band domain representation of the first subband signal is that it does not form a compact representation, i.e., it is oversampled by a factor of two. The encoder 109 directly transforms the complex sub-band domain representation into a representation that closely resembles a representation which would have been obtained when applying a Modified Discrete Cosine Transform (MDCT) directly to the original time domain signal (See for example H. Malvar, "Signal Processing with Lapped Transforms", Artech House, Boston, London, 1992 for a description of the MDCT). This MDCT-like representation is critically sampled. As such, this signal is suitable for known perceptual audio coding techniques which can be applied in order to efficiently code the resulting representation resulting in an efficient waveform encoding.

In particular, the encoder 109 comprises a conversion processor 205 which generates a second subband signal from the first subband signal by applying a complex transform to the individual subbands of the first subband signal. The second subband signal corresponds to a critically sampled complex subband domain representation of the time domain audio signals.

Thus, in the encoder 109, the conversion processor 205 converts the QMF filter bank output, which is compatible with typical current parametric extension encoders, to a critically sampled MDCT-like subband that corresponds closely to the subband signals which are typically generated in conventional waveform encoders.

Thus, rather than using both QMF and MDCT transforms, the first subband signal is directly processed in the subband domain to generate a second subband signal that can be treated as an MDCT signal of a conventional waveform encoder. Thus, known techniques for encoding the subband signal can be applied and an efficient waveform encoding of e.g. a residual signal from a parametric extension encoding can be achieved without requiring a conversion to the time domain, and thus the requirement for QMF synthesis filters can be obviated.

In the example, the encoder 109 comprises an encode processor 207 which is coupled to the conversion processor 205. The encode processor 207 receives the second critically sampled MDCT-like subband signal from the conversion processor 205 and encodes this using conventional waveform coding techniques including e.g. quantization, scale factors, Huffman encoding etc. The resulting encoded data is embedded in an encoded data stream. The data stream can further comprise other encoded data, such as for example parametric encoding data.

As will be described in detail in the following, the conversion processor 205 utilizes information of the fundamental (or prototype) filter of the first filter bank 203 to combine signal components from different subbands in non-alias bands (or pass bands) and to remove signal components from alias bands (or stop-bands). Accordingly, the alias band frequency components for each subband can be ignored resulting in a critically sampled signal with no oversampling.

Specifically, as is described in the following, the conversion processor 205 comprises a second filter which generates a plurality of sub-subbands for each of the subbands of the QMF filter bank. Thus, the subbands are divided into further sub-subbands. Due to the overlap between QMF filters, a given signal component of the time domain signal (say a sinusoid at a specific frequency) may result in a signal component in two different QMF subbands. The second filter bank will further divide these subbands such that the signal component will be represented in one sub-subband of the first QMF subband and in one sub-subband of the second QMF subband. The data values of these two sub-subband signals are fed to the combiner which combines the two signals to generate a single signal component. This single signal component is then encoded by the encode processor 207.

Figure 3:
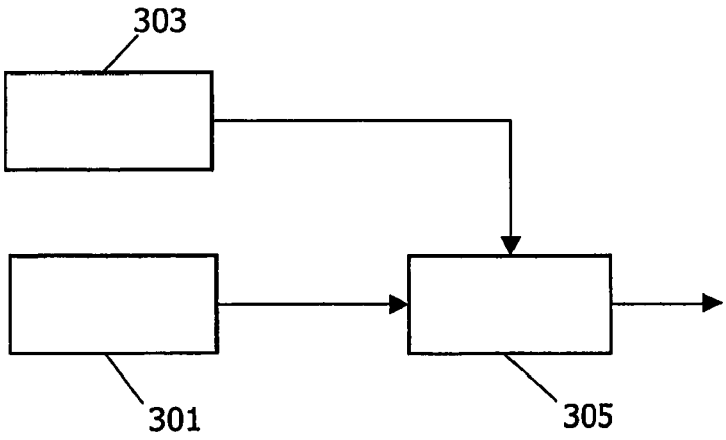
FIG. 3 illustrates an example of some elements of an encoder in accordance with some embodiments of the invention.

FIG. 3 illustrates an example of some elements of the conversion processor 205. In particular, FIG. 3 illustrates a first conversion filter bank 301 for a first QMU subband and a second conversion filter bank 303 for a second QMF subband. The signals from the sub-subbands which correspond to the same frequencies are then fed to the combiner 305 which generates a single output data value for the sub-subband.

Figure 4:
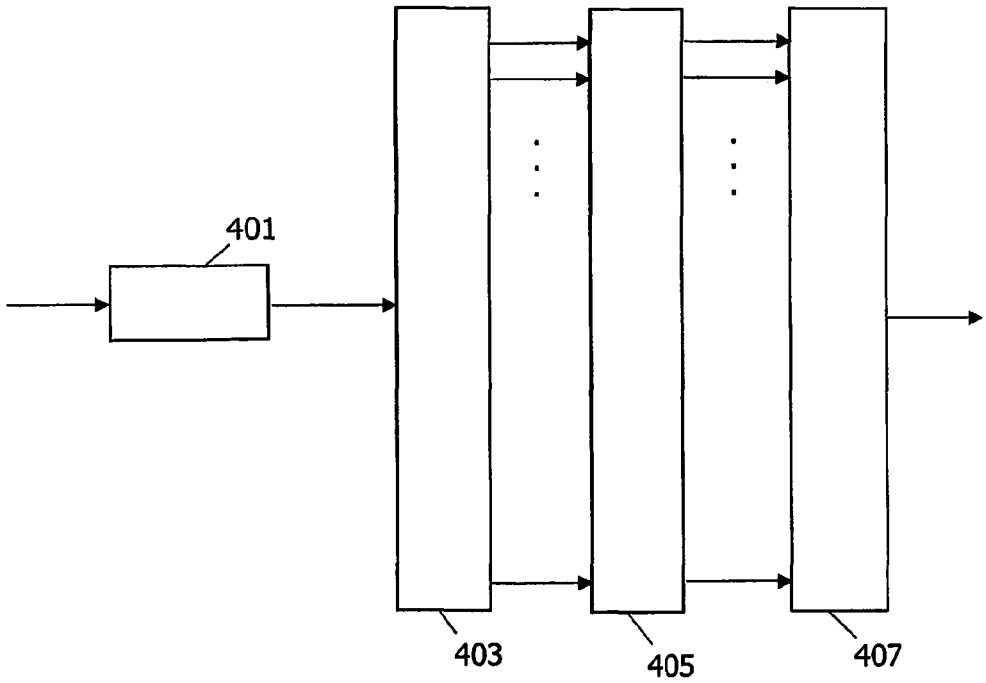
FIG. 4 illustrates a decoder in accordance with some embodiments of the invention.

It will be appreciated that the decoder 115 may perform the inverse operations of the encoder 109. FIG. 4 illustrates the decoder 115 in more detail.

The decoder comprises a receiver 401 which receives the signal encoded by the encoder 109 from the network receiver 113. The encoded signal is passed to a decoding processor 403 which decodes the waveform encoding of the encode processor 207 thereby recreating the critically sampled subband signal. This signal is fed to a decode conversion processor 405 which recreates the non-critically sampled subband signal by performing the inverse operation of the conversion processor 205. The non-critically sampled signal is then fed to a QMF synthesis filter 407 which generates a decoded version of the original time domain audio encoding signal.

In particular, the decode conversion processor 405 comprises a splitter, such as an inverse Butterfly structure, that regenerates the signal components in the sub-subbands including the signal bands in both the alias and non-alias bands. The sub-subband signals are then fed to a synthesis filter bank corresponding to the conversion filter bank 301, 303 of the encoder 109. The output of these filter banks correspond to the non-critically sampled subband signal.

Specific embodiments of the invention will be described in more detail in the following. The description of the embodiments will be described with reference to the encoder structure 500 of FIG. 5. The encoder structure 500 may specifically be implemented in the encoder 109 of FIG. 1.

The encoder structure 500 comprises a 64 band analysis QMF filter bank 501.

The QMF analysis sub-band filter can be described as follows. Given a real valued linear phase prototype filter p(v), an M-band complex modulated analysis filter bank can be defined by the analysis filters $$h_k(v) = p(v)\exp\left\{i\frac{\pi}{M}(k+1/2)(v-\theta)\right\}, \tag{1}$$

for sub-band index k=0, 1, . . . , M−1. The phase parameter θ has importance for the analysis that follows. A typical choice is (N+M)/2, where N is the prototype filter order.

Figure 6:
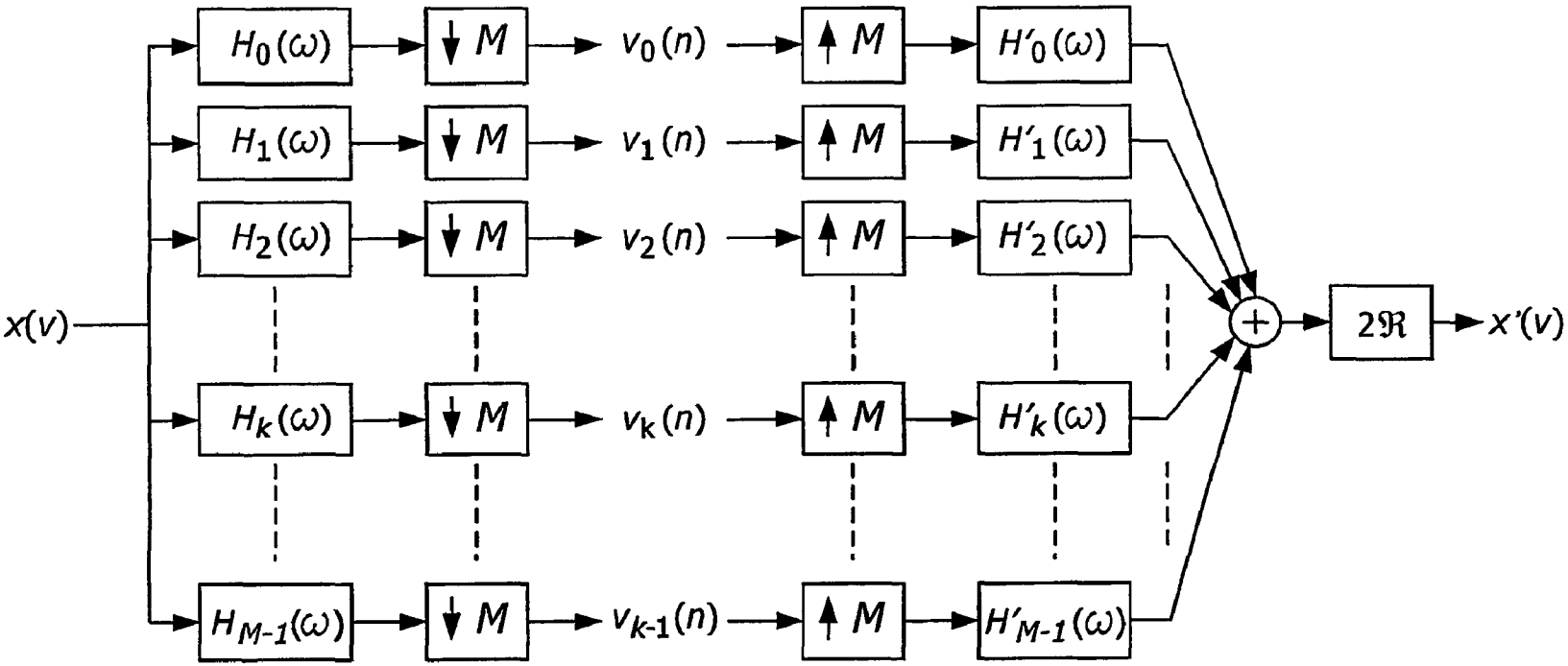
FIG. 6 illustrates an example of an analysis and synthesis filter bank.

Given a real valued discrete time signal x(v), the sub-band signals $v_k(n)$ are obtained by filtering (convolution) x(v) with $h_k(v)$, and then downsampling the result by a factor M as illustrated by the left hand side of FIG. 6 which illustrates the operation of the QMF analysis and synthesis filter banks of the encoder 109 and the decoder 115.

Assume that a synthesis operation consists of first upsampling the QMF sub-band signals with a factor M, followed by filtering with complex modulated filters of type similar to equation (1), adding the results and finally taking twice the real part as illustrated by the right hand side of FIG. 6. In such a case, near-perfect reconstruction of the real valued input signal x(ν) can be obtained by suitable design of a real valued linear phase prototype filter p(ν), as shown in P. Ekstrand, "Bandwidth extension of audio signals by spectral band replication", Proc. 1st IEEE Benelux Workshop on Model based Processing and Coding of Audio (MPCA-2002), pp. 53-58, Leuven, Belgium, Nov. 15, 2002.

In the following, let $Z(\omega)=\Sigma_{n=-\infty}^{\infty} z(n)\exp(-in\omega)$ be the discrete time Fourier transform of a discrete time signal z(n).

In addition to the near-perfect reconstruction property of the QMF bank, it will be assumed that P(ω), the Fourier transform of p(ν), essentially vanishes outside the frequency interval [−π/M, π/M].

The Fourier transform of the downsampled complex subband domain signals is given by:

$$Y_k(\omega) = \frac{\exp(-i(k+1/2)\theta/M)}{M}\sum_{l=0}^{M-1} P\left(\frac{\omega-\pi(2l+k+1/2)}{M}\right)\times\left(\frac{\omega-2\pi l}{M}\right) \quad (2)$$

where k is the sub-band index and M is the number of subbands. Due to the assumption of the frequency response of the prototype filter being limited, the sum in equation (2) contains only one term for each ω.

Figure 7:
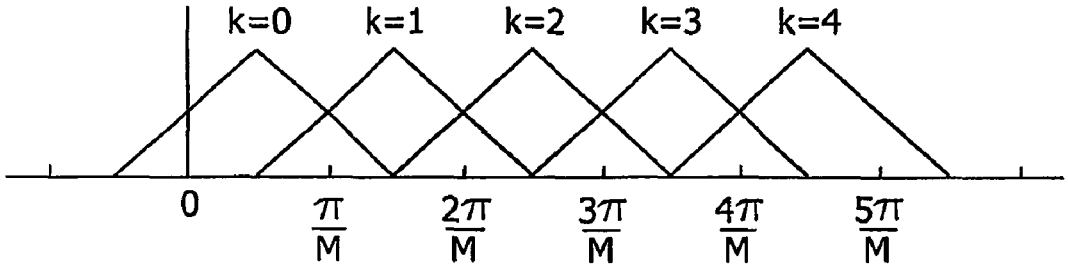
FIG. 7 illustrates an example of a QMF filter bank spectrum.
Figure 8:
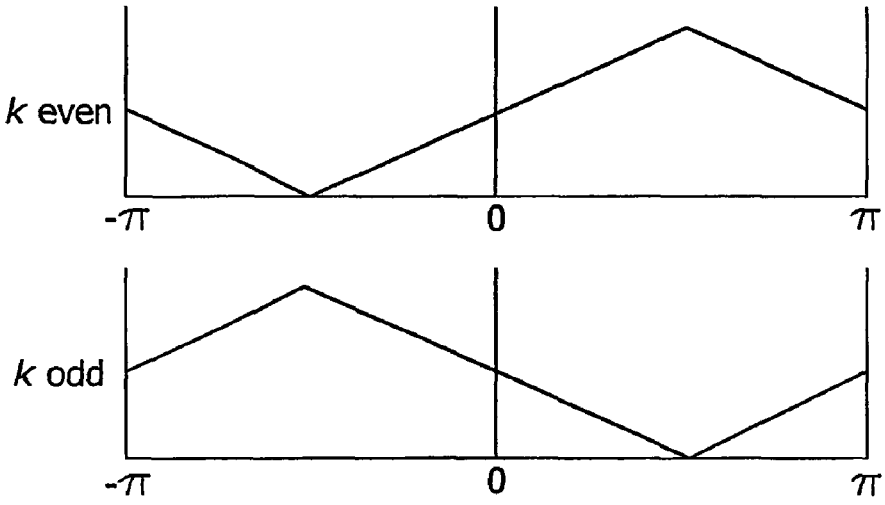
FIG. 8 illustrates examples of down-sampled QMF subband filter spectra.

The corresponding stylized absolute frequency responses are shown in FIG. 7 and FIG. 8.

Specifically, FIG. 7 illustrates the stylized frequency responses for the first few frequency bands of the complex QMF bank 501 prior to downsampling. FIG. 8 illustrates the stylized frequency responses of the downsampled complex QMF bank for even (top) and odd (bottom) subbands k. Thus, as illustrated in FIG. 8 the center of a QMF filter band will after down sampling be aliazed to π/2 for even numbered subbands and to −π/2 for uneven numbered subbands.

FIG. 8 illustrates the effect of the oversampling of the complex QMF bank. For the bands with even index k and odd index k, respectively the negative and positive part of the frequency spectrum are not required in order to reconstruct the (originally real-valued) signal. These parts of the frequency spectrum of the downsampled filter bank will be referred to as the aliazed bands or stop bands, whereas the other parts will be indicated as the pass band or non-aliazed band. It is noted that the aliazed bands contain information which is also present in the pass bands of the spectra of other subbands. This particular property will be used to derive an efficient coding mechanism.

It will be appreciated that the alias and non-alias bands comprises redundant information and that one can be determined from the other. It will also be appreciated that the complementary interpretation of alias and non-alias bands can be used.

As will be shown in the following, the energies corresponding to the aliazed bands (or stop bands) of the QMF analysis filter bank can be reduced to zero or negligible values by applying a certain type of additional filter bank 503 at each output of the down-sampled analysis filter bank 501 and applying certain butterfly structures 505 between the outputs of the additional filter banks 501.

As a consequence, half of the information, i.e., half of the filter bank outputs can be discarded. As a result, a critically sampled representation is obtained. This representation is very similar to the representation achieved by an MDCT transform of the original time domain samples and therefore closely resembles the subband signals which are generated by typical waveform encoders such as MP3 or AAC. Accordingly, waveform encoding techniques can be applied directly to the critically sampled signal in the waveform encode processor 507 and no requirement for a conversion to the time domain followed by an MDCT subband generation is required. The resulting encoded data is then included in a bitstream by a bitstream processor 509.

Figure 9:
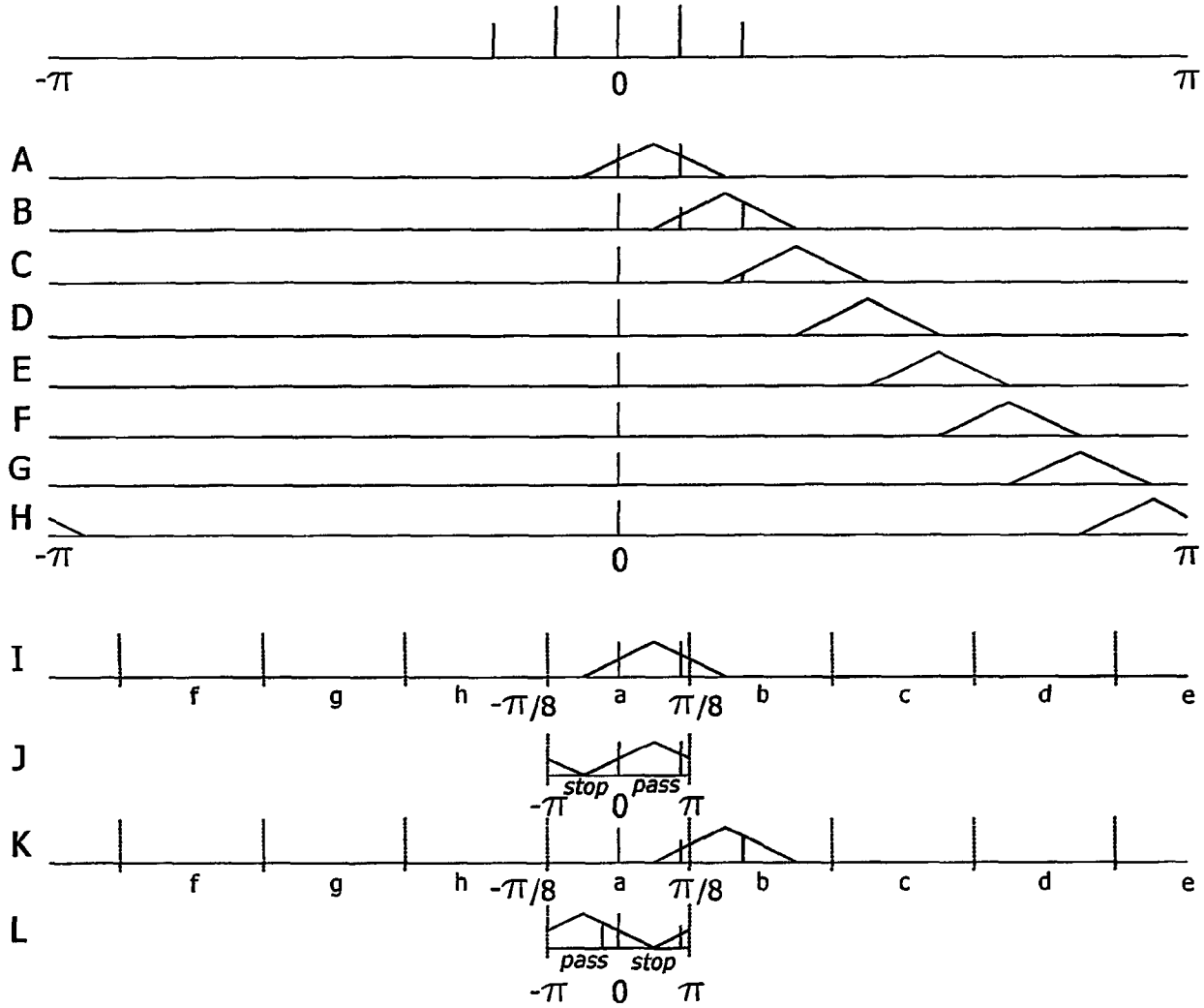
FIG. 9 illustrates examples of QMF subband spectra.

FIG. 9 illustrates the effect of the QMF subband generation for a signal consisting of two sinusoids.

In the complex frequency domain (such as e.g. obtained by means of an FFT) each sinusoid will show up in the spectrum as both a positive and negative frequency. Now assume a 8-bands complex QMF bank (in the example of FIG. 5 a 64-bands bank is employed). Prior to downsampling, the sinusoids will show up as illustrated in spectra A to H. As illustrated, each sinusoid occurs in two subbands, e.g. the low frequency spectral line occurs in both spectrum A, corresponding to the first QMF subband, as well as spectrum B, corresponding to the second QMF subband.

The process of downsampling of the QMF bank is illustrated in the lower part of FIG. 9, where spectrum I shows the spectrum prior to downsampling. The downsampling procedure can be interpreted as following. First the spectrum is split into M spectra A to H, where M is the downsampling factor (M=8) as illustrated in I and K for the first and second subband respectively. Each individual split spectrum is expanded (stretched) again to the full frequency range. Then all the individual split and expanded spectra are added resulting in the spectra as illustrated in spectrum J and L for the first and second sub-band respectively.

In summary, due to the filter of each individual subband having a bandwidth which exceeds the frequency interval between subbands, signal components of the time domain signal will result in signal components in two different subbands. Furthermore, one of these signal components will fall in the alias band of one of the subbands and one will fall in the non-alias band of the other subband.

Thus, as shown in spectrum J and L, in the final output spectra of the complex QMF bank, the components still occur in two subbands, e.g., the low frequency spectral line occurs in the pass band of the first subband as well as in the stop-band of the second subband. The magnitude of the spectral line in both cases is given by the frequency response of the (shifted) prototype filter.

Figure 5:
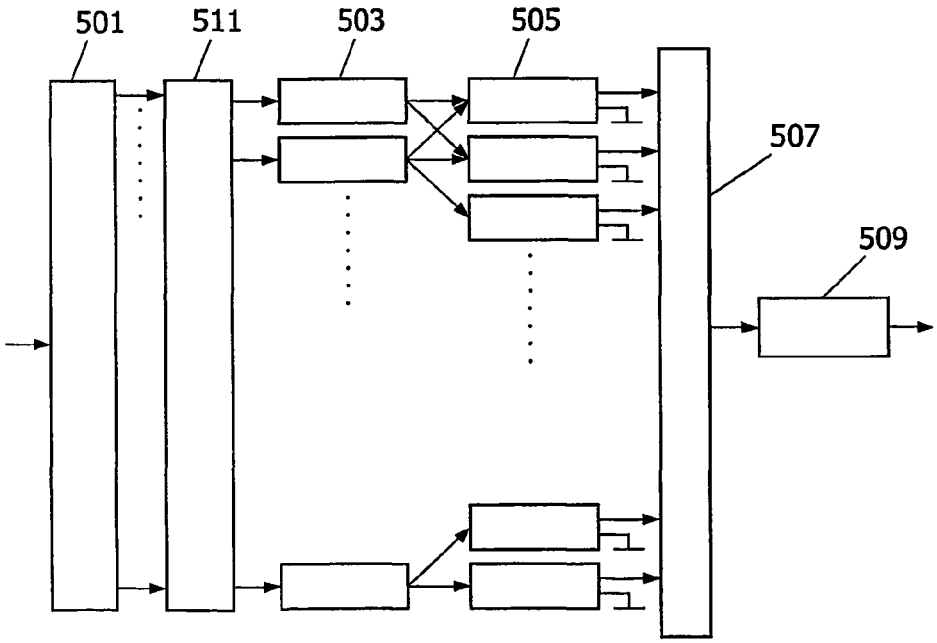
FIG. 5 illustrates an encoder in accordance with some embodiments of the invention.

In accordance with the embodiments of FIG. 5, an additional set of complex transforms (the filter bank 503) is introduced where each transform is applied to the output of a sub-band. This is used to further split the frequency spectrum of those sub-bands into a plurality of sub-subbands.

Each sub-subband in the pass band of a QMF subband is then combined with the correspond sub-subband of the alias band in the adjacent QMF subband. In the example, the sub-subband comprising the low frequency sinusoid in spectrum J is combined with the low frequency sinusoid in spectrum L thus resulting in both signal components arising frog the same low frequency sinusoid of the time domain signal being combined into a single signal component.

Furthermore, in order to compensate for the frequency response of the QMF prototype filter, the value from each sub-subband is weighted by the relative amplitude of the frequency response before the combining (it is assumed that the amplitude response of the QMF prototype filter is constant within each sub-subband).

The signal components in the stop bands can be ignored or may be compensated by the values from the pass band thereby effectively reducing the energy in the alias band. Thus, the operation of the conversion processor 207 can be seen as corresponding to concentrating the energy of the two signal components arising for each frequency into a single signal component in the pass band of one of the QMF subbands. Thus, as the signal values in the alias or stop bands can be ignored, an efficient down sampling by two can be achieved resulting in a critically sampled signal.

As will be shown in the following, the combining of the signal components (and the cancellation of signal components in the alias bands) can be achieved by using a Butterfly structure.

In principle, applying another (50% overlapping) complex transform (by the filter banks 503) on the sub-band signals would yield another upsampling of a factor of: 2. However, the chosen transforms possess a certain symmetric property allowing a reduction of 50% of the data. The resulting transform can be considered equivalent to applying an MDCT to the real data and an MDST to the imaginary data. Both are critically sampled transforms, and thus no upsampling occurs.

Figure 10:
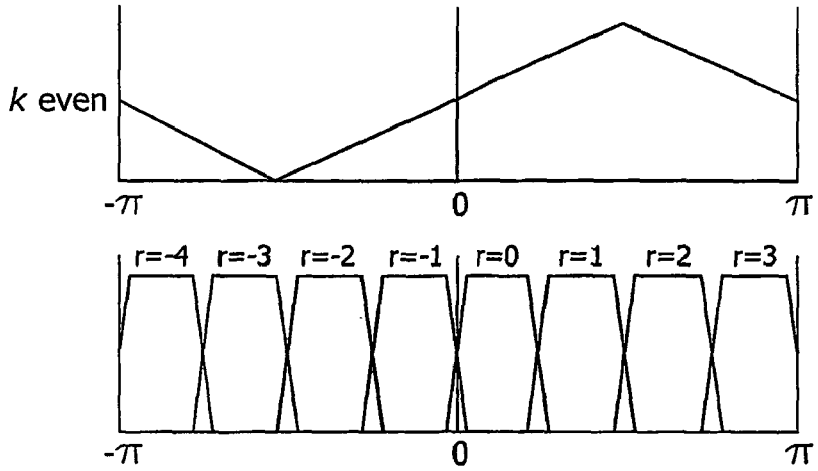
FIG. 10 illustrates examples of spectra of a subband filter bank.

In more detail, the filter banks 503 can be a complex-modulated filter bank consisting of R=2Q bands. An example of a stylized frequency response of the filter banks 503 for each subband are shown in FIG. 10, for each sub-band k. As can be seen the filter bank is oddly stacked and has no sub-band centered around the DC value. Rather, in the example, the center frequencies of the subbands are symmetric around zero with the center frequency of the first subband being around half the subband frequency offset.

The downsampling factor in this second bank is Q and it is defined by the analysis filters, for r=−Q, −Q+1, . . . , Q−1, $$g_r(v) = w(v)\exp\left\{i\frac{\pi}{Q}(r+1/2)(v-1/2)\right\} \tag{3}$$

where the real valued prototype window w(ν) is such that w(ν)=(−ν−1−Q). It is well known that this window can be designed such that perfect reconstruction can be achieved from analysis in a filter bank with filters being equal to either the real part of (3) or the imaginary part of (3). In those cases, only Q of the R=2Q subbands suffice, either positive or negative frequencies. A prominent example is the modified discrete cosine transform MDCT.

However, in the embodiment of FIG. 5 a complex valued signal z(n) is instead analyzed with the filters 503, the resulting signals are downsampled by a factor Q and the real part is taken. The corresponding synthesis operation consists of upsampling by a factor Q, and synthesis filtering by the complex modulated filters, $$f_r(v) = w(v-Q)\exp\left\{i\frac{\pi}{Q}(r+1/2)(v+1/2)\right\}, \tag{4}$$

summing the results over the R=2Q subbands, r=−Q, −Q+1, . . . , Q−1, and finally dividing the result by two.

If the prototype window w(ν) is designed to give perfect reconstruction in the real valued banks mentioned above, the combined operation of analysis and synthesis in the complex case will perfectly reconstruct the complex valued signal z(n). To see this, let C represent the analysis bank that has analysis filters equal to the real part of (3), and let S represent the analysis bank that has analysis filters equal to minus the imaginary part of (3). Then the complex analysis bank (3) can be written as E=C−iS. Writing the complex signal as z=ξiη then gives $$Re\{Ez\}=Re\{(C-iS)(\xi+i\eta)\}=C\xi+S\eta. \tag{5}$$

Here (5) is evaluated for both positive frequencies r=0, . . . , Q−1, and negative frequencies r=−Q, . . . −1. Note that changing r to −1−r in (3) leads to a complex conjugation of the analysis filter, so the analysis (5) gives access to both Cξ+Sη and Cξ−Sη for positive frequencies r=0, . . . , Q−1. For synthesis this information can be easily recombined into Cξ and Sη, from which perfect reconstruction of both ξ and η is possible with the corresponding real valued synthesis banks. We omit the straightforward details of proving the claim that this reconstruction is equivalent to the operation of complex analysis, real part, complex synthesis, and division by two.

This filter bank structure is related, but not identical to, the modified DFT (MDFT) filter banks as proposed in Karp T., Fliege N.J., "Modified DFT Filter Banks with Perfect Reconstruction", IEEE Transactions on Circuits and Systems-II: Analog and Digital Signal Processing, Vol. 46, No. 11, November 1999. A principal difference is that the present filter bank is oddly stacked, a fact which is advantageous for the following proposed hybrid structure.

For each k=0, 1, . . . , M−1 and r=−Q, −Q+1, . . . , Q−1, let $V_{k,r}(n)$ be the sub-subband signal achieved by analysis of the complex QMF analysis signal $y_k(v)$ with the analysis filter 503, downsampling by a factor Q, and taking the real part. This gives a total of 2 QM real valued signals at a sampling rate of 1/(QM) of the original sampling rate. Hence, a representation oversampled by a factor two is obtained. Referring to FIGS. 8 and 10, it is convenient to define the pass band signals by $$b_{k,r}(n) = \left\{\begin{matrix} v_{k,r}(n) & \text{for } k \text{ even} \\ v_{k,r-Q}(n) & \text{for } k \text{ odd} \end{matrix}\right\},\ r = 0, \ldots, Q-1. \tag{6}$$

Similarly the stop band or "aliazed band" signals referred to above are defined from $$a_{k,r}(n) = \left\{\begin{matrix} v_{k,r-Q}(n) & \text{for } k \text{ even} \\ v_{k,r}(n) & \text{for } k \text{ odd} \end{matrix}\right\},\ r = 0, \ldots, Q-1. \tag{7}$$

Observe that both these signals are critically sampled.

The next step is to exploit the fact that if the time signal is a pure sinusoid at frequency π/(2M)≦Ω≦π−π/(2M) and if θ=0 in (1), then $$y_k(n) = P\left\{\Omega - \frac{\pi}{2M}(2k+1)\right\}C\exp(i\Omega Mn). \tag{8}$$

where C is a complex constant. As a result, neighboring QMF bands will thus contain complex sinusoids with the same frequency and phase but with different magnitudes, due the response of the modulated linear phase QMF prototype filter. Thus, as mentioned previously, two signal components arise—one in the pass band of one QMF subband and one in the alias band of an adjacent subband.

Transforming the corresponding pairs of sub-subband samples into weighted sums and differences will therefore lead to very small differences. Before the details of this transform is outlined, it should be pointed out that if the assumption that $\theta=0$ is not satisfied, the QMF samples should preferably be phase compensated by being pre-multiplied (pre-twiddling) in a pre-twiddle processor 511 according to $$\tilde{y}_k(n)=\exp(i\pi\theta(k+1/2)M)y_k(n). \tag{9}$$

Alternatively an additional phase jump of $k\pi$ in the pre-twiddle processor could also be handled by the butterfly structure by sign negation.

For k=0, . . . , M−2 the sum and difference signals are defined by $$\begin{cases} s_{k,r}(n) = \beta_{k,r}b_{k,r}(n) + \alpha_{k,r}a_{k+1,r}(n) \\ d_{k+1,r}(n) = -\alpha_{k,r}b_{k,r}(n) + \beta_{k,r}a_{k+1,r}(n) \end{cases}, \tag{10}$$

$$r = Q/2, \ldots, Q-1,$$

$$\begin{cases} s_{k+1,r}(n) = \beta_{k,r}b_{k+1,r}(n) + \alpha_{k,r}a_{k,r}(n) \\ d_{k,r}(n) = \alpha_{k,r}b_{k+1,r}(n) - \beta_{k,r}a_{k,r}(n) \end{cases},$$

$$r = 0, \ldots, Q/2-1.$$

For the first and last QMF bands, the definition is replaced by $$\begin{cases} s_{0,r}(n) = \beta_{0,r}b_{0,r}(n) = \alpha_{o,r}a_{0,Q-1-r}(n) \\ d_{o,Q-1-r}(n) = \alpha_{0,r}b_{0,r}(n) - \beta_{0,r}a_{0,Q-1-r}(n) \end{cases}, \tag{11}$$

$$r = 0, \ldots, Q/2-1$$

$$\begin{cases} s_{M-1,r}(n) = \beta_{M-1,r}b_{M-1,r}(n) + \alpha_{M-1,r}a_{M-1,Q-1-r}(n) \\ d_{M-1,Q-1-r}(n) = -\alpha_{M-1,r}b_{M-1,r}(n) + \beta_{M-1,r}a_{M-1,Q-1-r}(n) \end{cases},$$

$$r = Q/2, \ldots, Q-1$$

Figure 11:
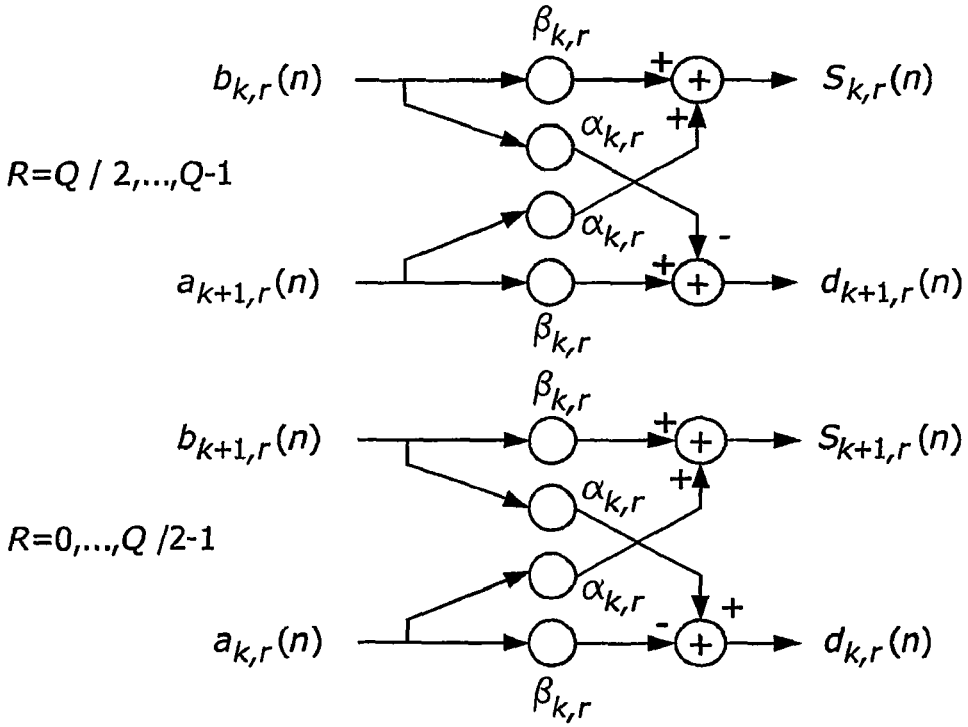
FIG. 11 illustrates an example of Butterfly transform structures.

FIG. 11 illustrates the corresponding transform Butterfly structures. These butterfly structures are similar to those used in MPEG-1 Layer III (MP3). However, an important difference is that the so-called anti-aliasing butterflies of mp3 are used to reduce the aliasing in the pass bands of the real-valued filter bank. In a real modulated filter bank, it is not possible to distinguish between positive and negative (complex) frequencies in the subbands. In the synthesis step, one sinusoid in the subband will therefore generally give rise to two sinusoids in the output. One of those, the aliazed sinusoid, is located at a frequency quite far from the correct frequency. The real bank anti-aliasing butterflies aim at suppressing the aliazed sinusoid by directing the second hybrid bank synthesis into two neighboring real QMF bands. The present approach differs fundamentally from this situation in that the complex QMF subband is fed with a complex sinusoid from the second hybrid bank. This gives rise to only one correctly located sinusoid in the final output, and the alias problem of MP3 never occurs. The Butterfly structures 505 aim solely at correcting the magnitude response of the combined analysis and synthesis operation, when the difference signals d are omitted.

Note first that if the transform coefficients are set to $\beta_{k,r}=1$ and $\alpha_{k,r}=0$, then the signal pair (s,d) will just be a copy of the pair (b,a). This can be done in a selective way since the structure of (10) and (11) is such that computations can be done in place. This has importance for the case where the hybrid filter bank structure is only invoked for a subset of QMF bands. All the sum and difference operations are invertible as long as $\beta_{k,r}^2+\alpha_{k,r}^2>0$ and the transformation is orthogonal if $\beta_{k,r}^2+\alpha_{k,r}^2=1$.

The corresponding synthesis steps are very similar to (10) and (11) and will be clear to the skilled person. This holds also for the inversion of the pre-twiddling by the pre-twiddle processor 511. The present approach teaches that the signals $d_{k,r}(n)$ become very small for the choice where both $\beta_{k,Q-1-r}=\beta_{k,r}$ and $\alpha_{k,Q-1-r}=\alpha_{k,r}$, and $$\begin{cases} \beta_{k,r} = KP\left(\frac{\pi}{M}\left(\frac{r+1/2}{Q} - \frac{1}{2}\right)\right) \\ \alpha_{k,r} = KP\left(\frac{\pi}{M}\left(\frac{r+1/2}{Q} + \frac{1}{2}\right)\right) \end{cases}, r = 0, \ldots, Q/2-1, \tag{12}$$

where K is a normalization constant.

So, under the assumption that the additional filter bank for each sub-band k is critically sampled and perfectly reconstructing, the approximation of the alias band sub-subband domain signals practically reduces the oversampled representation to a critically sampled representation closely resembling the MDCT of the original time domain samples. This allows efficient coding of the complex sub-band domain signals in a fashion similar to known perceptual waveform coders. The reconstruction error of discarding the transform coefficients corresponding to the stop or alias bands is in the order of 34 dB for a typical transform length Q=16.

Alternatively the coefficients corresponding to the stop bands or alias bands could be encoded additionally to the coefficients corresponding to the pass bands in order to obtain a better reconstruction. This could be beneficial in case Q is very small (e.g. Q<8) or in case of a poor performance of the QMF bank.

In the example of FIG. 5, the sum-difference butterflies of (10) and (11) 505 are applied in order to obtain the signal pair (s,d) of which in this case only the dominant components (s) are preserved. In a next step, conventional waveform coding techniques using e.g. scale-factor coding and quantization are applied on the resulting signal(s). The coded coefficients are embedded into a bit stream.

The decoder follows the inverse process. First, the coefficients are de-multiplexed from the bit stream and decoded. Then, the inverse butterfly operation of the encoder is applied followed by synthesis filtering and post-twiddling to obtain the complex sub-band domain signals. These can finally be transformed to the time domain by means of the QMF synthesis bank.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units.

As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A decoder for generating a time domain audio signal by waveform decoding, the decoder comprising:

a receiver for receiving an encoded data stream;

a generator for generating a first subband signal by decoding data values of the encoded data stream, the first subband signal corresponding to a critically sampled subband domain signal representation of the time domain audio signal;

a converter for generating a second subband signal from the first subband signal or a processed version thereof by subband processing, the second subband signal corresponding to a non-critically sampled complex subband domain representation of the time domain audio signal;

a parametric decoder for parametric decoding parametric data using the second subband signal; and a synthesis filter bank for generating the time domain audio signal from the second subband signal.

2. The decoder of claim 1 wherein each subband of the first subband signal comprises a plurality of sub-subbands and the converter comprises a second synthesis filter bank for generating the subbands of the second subband signals from sub-subbands of the first subband signal.

3. The decoder of claim 2 wherein each subband of the second subband signal comprises an alias band and a non-alias band and wherein the converter comprises a splitter for splitting a sub-subband of the first subband signal into an alias sub-subband of a first subband band of the second subband signal and a non-alias subband of a second subband of the second subband signal, the alias subband and the non-alias subband having corresponding frequency intervals in the time domain signal.

4. The decoder of claim 3 wherein the splitter comprises a Butterfly structure.

5. An audio playing device comprising a decoder according to claim 1.

6. An encoder for encoding a time domain audio signal, the encoder comprising:

a receiver for receiving the time domain audio signal;

a first filter bank for generating a first subband signal from the time domain audio signal, the first subband signal corresponding to a non-critically sampled complex subband domain representation of the time domain signal;

a parametric encoder for parametrically encoding the time domain audio signal using the first subband signal;

a converter for generating a second subband signal from the first subband signal or a processed version thereof by subband processing, the second subband signal corresponding to a critically sampled subband domain representation of the time domain audio signals; and a generator for generating a waveform encoded data stream by encoding data values of the second subband signal.

7. The encoder of claim 6 wherein the converter comprises a second filter bank for generating a plurality of sub-subbands for each subband of the first subband signal.

8. The encoder of claim 7 wherein the second filter bank is oddly stacked.

9. The encoder of claim 7 wherein each subband comprises some alias sub-subbands corresponding to an alias band of the subband and some non-alias sub-subbands corresponding to a non-alias band of the subband; and wherein the converter comprises a combiner for combining alias sub-subbands of a first subband band with non-alias sub-subbands of a second subband, the alias sub-subbands and the non-alias sub-subbands having corresponding frequency intervals in the time domain signal.

10. The encoder of claim 9 wherein the combiner are arranged to reduce an energy in the alias band.

11. The encoder of claim 9 wherein the combiner comprises a signal generator for generating a non-alias sum signal for a first alias sub-subband in the first subband and a first non-alias sub-subband in the second subband.

12. The encoder of claim 11 wherein the combiner comprises a butterfly structure for generating the non-alias sum signal.

13. The encoder of claim 12 wherein at least one coefficient of the butterfly structure is dependent on a frequency response of a filter of the first filter bank.

14. The encoder of claim 9 wherein the converter is arranged to not include data values for the alias band in the encoded data stream.

15. The encoder of claim 6 further comprising a non-alias signal processor for performing non-alias signal processing on the first subband signal prior to the conversion to the second signal.

16. The encoder of claim 6 further comprising a phase compensator for phase compensating the first subband signal prior to the conversion to the second signal.

17. The encoder of claim 6 wherein the first filter bank is a QMF filter bank.

18. An audio recording device comprising an encoder according to claim 6.

19. A method of generating a time domain audio signal by waveform decoding, the method comprising:

receiving an encoded data stream;

generating a first subband signal by decoding data values of the encoded data stream, the first subband signal corresponding to a critically sampled subband domain signal representation of the time domain audio signal;

generating a second subband signal from the first subband signal or a processed version thereof by subband processing, the second subband signal corresponding to a non-critically sampled complex subband domain representation of the time domain audio signal parametric decoding parametric data using the second subband signal; and a synthesis filter bank generating the time domain audio signal from the second subband signal.

20. A method of encoding a time domain audio signal, the method comprising:

receiving the time domain audio signal;

a first filter bank generating a first subband signal from the time domain audio signal, the first subband signal corresponding to a non-critically sampled complex subband domain representation of the time domain signal;

parametrically encoding the time domain audio signal using the first subband signal;

generating a second subband signal from the first subband signal or a processed version thereof by subband processing, the second subband signal corresponding to a critically sampled subband domain representation of the time domain audio signals; and generating a waveform encoded data stream by encoding data values of the second subband signal.

21. A receiver for receiving an audio signal, the receiver comprising:

a receiver for receiving an encoded data stream;

a generator for generating a first subband signal by decoding data values of the encoded data stream, the first subband signal corresponding to a critically sampled subband domain signal representation of the time domain audio signal;

a converter for generating a second subband signal from the first subband signal or a processed version thereof by subband processing, the second subband signal corresponding to a non-critically sampled complex subband domain representation of the time domain audio signal;

a parametric decoder for parametric decoding parametric data using the second subband signal; and a synthesis filter bank for generating a time domain audio signal from the second subband signal.

22. A transmitter for transmitting an encoded audio signal, the transmitter comprising:

a receiver for receiving a time domain audio signal;

a first filter bank for generating a first subband signal from the time domain audio signal, the first subband signal corresponding to a non-critically sampled complex subband domain representation of the time domain signal;

a parametric encoder for parametrically encoding the time domain audio signal using the first subband signal;

a converter for generating a second subband signal from the first subband signal or a processed version thereof by subband processing, the second subband signal corresponding to a critically sampled subband domain representation of the time domain audio signals; and a generator for generating a waveform encoded data stream by encoding data values of the second subband signal; and a transmitter for transmitting the waveform encoded data stream.

23. A transmission system for transmitting a time domain audio signal, the transmission system comprising:

a transmitter comprising:

a receiver for receiving the time domain audio signal, a first filter bank for generating a first subband signal from the time domain audio signal, the first subband signal corresponding to a non-critically sampled complex subband domain representation of the time domain signal, a parametric encoder for parametrically encoding the time domain audio signal using the first subband signal;

a converter for generating a second subband signal from the first subband signal or a processed version thereof by subband processing, the second subband signal corresponding to a critically sampled subband domain representation of the time domain audio signals, a generator for generating a waveform encoded data stream by encoding data values of the second subband signal, and a transmitter for transmitting the waveform encoded data stream;

and a receiver comprising:

a receiver for receiving the waveform encoded data stream, a generator for generating a third subband signal by decoding data values of the encoded data stream, the third subband signal corresponding to a critically sampled complex subband domain signal representation of the time domain audio signal, a converter for generating a fourth subband signal from the third subband signal or a processed version thereof by subband processing, the fourth subband signal corresponding to a non-critically sampled complex subband domain representation of the time domain audio signal;

a parametric decoder for parametric decoding parametric data using the fourth subband signal; and a synthesis filter bank for generating a time domain audio signal from the fourth subband signal.

24. A method of receiving an audio signal, the method comprising:

receiving an encoded data stream;

generating a first subband signal by decoding data values of the encoded data stream, the first subband signal corresponding to a critically sampled subband domain signal representation of the time domain audio signal;

generating a second subband signal from the first subband signal or a processed version thereof by subband processing, the second subband signal corresponding to a non-critically sampled complex subband domain representation of the time domain audio signal parametric decoding parametric data using the second subband signal; and generating a time domain audio signal from the second subband signal using a synthesis filter bank.

25. A method of transmitting an encoded audio signal, the method comprising:

receiving a time domain audio signal;

a first filter bank generating a first subband signal from the time domain audio signal, the first subband signal corresponding to a non-critically sampled complex subband domain representation of the time domain signal;

parametrically encoding the time domain audio signal using the first subband signal;

generating a second subband signal from the first subband signal or a processed version thereof by subband processing, the second subband signal corresponding to a critically sampled subband domain representation of the time domain audio signals; and generating a waveform encoded data stream by encoding data values of the second subband signal; and transmitting the waveform encoded data stream.

26. A method of transmitting and receiving a time domain audio signal, the method comprising:

a transmitter:

receiving the time domain audio signal, a first filter bank generating a first subband signal from the time domain audio signal, the first subband signal corresponding to a non-critically sampled complex subband domain representation of the time domain signal, parametrically encoding the time domain audio signal using the first subband signal;

generating a second subband signal from the first subband signal or a processed version thereof by subband processing, the second subband signal corresponding to a critically sampled subband domain representation of the time domain audio signals, generating a waveform encoded data stream by encoding data values of the second subband signal, and transmitting the waveform encoded data stream;

and a receiver:

receiving the waveform encoded data stream, generating a third subband signal by decoding data values of the encoded data stream, the third subband signal corresponding to a critically sampled subband domain signal representation of the time domain audio signal, generating a fourth subband signal from the third subband signal or a processed version thereof by subband processing, the fourth subband signal corresponding to a non-critically sampled complex subband domain representation of the time domain audio signal parametric decoding parametric data using the fourth subband signal; and generating a time domain audio signal from the fourth subband signal using a synthesis filter bank.

27. A computer program product for executing the method of claim 19.

28. A decoder for generating a time domain audio signal by waveform decoding, the decoder comprising:

a receiver for receiving an encoded data stream;

a generator for generating a first subband signal by decoding data values of the encoded data stream, the first subband signal corresponding to a critically sampled subband domain signal representation of the time domain audio signal;

a converter for generating a second subband signal from the first subband signal or a processed version thereof by subband processing, the second subband signal corresponding to a non-critically sampled complex subband domain representation of the time domain audio signal; and a synthesis filter bank for generating the time domain audio signal from the second subband signal, wherein each subband of the first subband signal comprises a plurality of sub-subbands and the converter comprises a second synthesis filter bank for generating the subbands of the second subband signals from sub-subbands of the first subband signal.

29. A method of generating a time domain audio signal by waveform decoding, the method comprising:

receiving an encoded data stream;

generating a first subband signal by decoding data values of the encoded data stream, the first subband signal corresponding to a critically sampled subband domain signal representation of the time domain audio signal;

generating a second subband signal from the first subband signal or a processed version thereof by subband processing, the second subband signal corresponding to a non-critically sampled complex subband domain representation of the time domain audio signal; and generating the time domain audio signal from the second subband signal using a synthesis filter bank, wherein each subband of the first subband signal comprises a plurality of sub-subbands and the step of generating a second subband signal from the first subband signal by subband processing uses a second synthesis filter bank for generating the subbands of the second subband signals from sub-subbands of the first subband signal.

30. A computer program product for executing the method of claim 29.

31. An encoder for encoding a time domain audio signal, the encoder comprising:

a receiver for receiving the time domain audio signal;

a first filter bank for generating a first subband signal from the time domain audio signal, the first subband signal corresponding to a non-critically sampled complex subband domain representation of the time domain signal;

a converter for generating a second subband signal from the first subband signal or a processed version thereof by subband processing, the second subband signal corresponding to a critically sampled subband domain representation of the time domain audio signals; and a generator for generating a waveform encoded data stream by encoding data values of the second subband signal, wherein the converter comprises a second filter bank for generating a plurality of sub-subbands for each subband of the first subband signal.

32. A method of encoding a time domain audio signal, the method comprising:

receiving the time domain audio signal;

a first filter bank generating a first subband signal from the time domain audio signal, the first subband signal corresponding to a non-critically sampled complex subband domain representation of the time domain signal;

generating a second subband signal from the first subband signal or a processed version thereof by subband processing, the second subband signal corresponding to a critically sampled subband domain representation of the time domain audio signals; and generating a waveform encoded data stream by encoding data values of the second subband signal, wherein the step of generating a second subband signal from the first subband signal by subband processing uses a second filter bank for generating a plurality of sub-subbands for each subband of the first subband signal.

33. A computer program product for executing the method of claim 32.

* * * * *